US009267651B2

(12) United States Patent
Tseng

(10) Patent No.: US 9,267,651 B2
(45) Date of Patent: Feb. 23, 2016

(54) CHRISTMAS LIGHT APPARATUS AND LAMP BASE THEREOF

(71) Applicant: Wei-Jen Tseng, Hsinchu County (TW)

(72) Inventor: Wei-Jen Tseng, Hsinchu County (TW)

( * ) Notice: Subject to any disclaimer, the term of this patent is extended or adjusted under 35 U.S.C. 154(b) by 162 days.

(21) Appl. No.: 13/908,128

(22) Filed: Jun. 3, 2013

(65) Prior Publication Data

US 2014/0355275 A1 Dec. 4, 2014

(30) Foreign Application Priority Data

Sep. 21, 2012 (CN) ..... 2012 2 0488579

(51) Int. Cl.

| | |
|---|---|
| ***H01R 33/00*** | (2006.01) |
| ***H01K 1/00*** | (2006.01) |
| ***H01K 1/46*** | (2006.01) |
| ***H01R 33/09*** | (2006.01) |
| ***H01R 24/00*** | (2011.01) |
| ***F21K 99/00*** | (2010.01) |
| ***F21S 4/00*** | (2006.01) |
| ***F21V 19/00*** | (2006.01) |
| ***F21V 23/06*** | (2006.01) |
| *F21Y 101/02* | (2006.01) |

(52) U.S. Cl.

CPC . *F21K 9/30* (2013.01); *F21S 4/001* (2013.01); *F21V 19/0025* (2013.01); *F21V 23/06* (2013.01); *H01R 33/09* (2013.01); *F21Y 2101/02* (2013.01)

(58) Field of Classification Search

CPC ..... F21W 2121/04; F21W 2121/004; F21W 2121/00; F21V 19/00; F21V 19/0005; H01R 33/09; H01R 33/22; H01R 4/18; H01R 33/965; H01R 4/185; F21S 4/001; H01K 1/46; H01K 9/00; H01J 5/56

USPC ..... 362/654; 439/614, 619, 699.2

See application file for complete search history.

(56) References Cited

U.S. PATENT DOCUMENTS

| | | | | |
|---|---|---|---|---|
| 6,019,483 | A * | 2/2000 | Lin | 362/653 |
| 6,595,657 | B1 * | 7/2003 | Shieh | 362/653 |
| 6,857,905 | B2 * | 2/2005 | Shieh | 439/619 |
| 7,063,452 | B2 * | 6/2006 | Kuo | 362/653 |
| 7,568,956 | B1 * | 8/2009 | Tseng | 439/699.2 |
| 7,575,362 | B1 * | 8/2009 | Hsu | 362/654 |
| 2003/0119374 | A1 * | 6/2003 | Wang | 439/699.1 |
| 2006/0258222 | A1 * | 11/2006 | Tseng | 439/620.1 |
| 2010/0254161 | A1 * | 10/2010 | Liu et al. | 362/654 |
| 2011/0074300 | A1 * | 3/2011 | Hsu | 315/185 S |
| 2011/0122613 | A1 * | 5/2011 | Hsu | 362/231 |

* cited by examiner

*Primary Examiner* — Jong-Suk (James) Lee
*Assistant Examiner* — Erin Kryukova
(74) *Attorney, Agent, or Firm* — Ming Chow; Sinorica, LLC

(57) ABSTRACT

A Christmas light apparatus has a holder, multiple electrode pads, a lamp base and an LED lamp. The electrode pads are mounted on an inner surface of the holder. The lamp base is mounted in the holder and has a top body and a bottom body. The top body has a top hole. The bottom body has multiple bottom grooves communicating with the top hole of the top body. The LED lamp is mounted on the top body and has multiple pins. The pins pass through the bottom body and are respectively bent upward along the bottom grooves of the bottom body. To assemble the Christmas light apparatus is easy and fast. The pins are respectively and tightly pressed between the lamp base and the electrode pads, such that the pins can hardly be disconnected from the electrode pads.

10 Claims, 9 Drawing Sheets

CHRISTMAS LIGHT APPARATUS AND LAMP BASE THEREOF

CROSS-REFERENCE TO RELATED APPLICATIONS

This application claims the benefit of China patent application No. 201220488579.7, filed on Sep. 21, 2012, the disclosure of which is incorporated herein in its entirety by reference.

BACKGROUND OF THE INVENTION

1. Field of the Invention

The present invention relates to a light apparatus, and more particularly to a Christmas light apparatus and a lamp base thereof.

2. Description of Related Art

With reference to FIG. 8, a conventional Christmas light apparatus is disclosed. The Christmas light apparatus has an LED device 50 and a holder 60. The holder 60 has a space 61 and a partition 62 formed in the space 61. The LED device 50 is mounted in the space 61 of the holder 60 and has a positive pin 51 and a negative pin 52. The positive pin 51 and the negative pin 52 are separated by the partition 62. Wires 63 are respectively welded to the positive pin 51 and the negative pin 52. The LED device 50 displays a single color. The luminance performance of the Christmas light apparatus is monotonous. In response to this drawback, an LED lamp displaying multiple colors is developed.

With reference to FIG. 9, an LED lamp that can display multiple colors is disclosed. The LED lamp has a package 70 and four pins 71. Each pin 71 has a first end and a second end. The second ends of the pins 71 are mounted in the package 70. The first ends of the pins 71 are adapted to be welded to wires. However, the LED lamp has too many pins 71, such that welding the wires to the pins 71 is highly time-consuming.

Each pin 71 of the LED lamp has its own function. If a wire is welded to a wrong pin 71, the LED lamp will be incorrectly activated with a wrong luminance color or will not be activated at all. In addition, since the wires are welded to the pins 71, the wires are not securely connected to the pins 71 and are easily disconnected from the pins 71. Hence, if the Christmas light apparatus is frequently hanged on and taken off a Christmas tree, the wires will be disconnected from the pins 71. The Christmas light apparatus is then out of order.

SUMMARY OF THE INVENTION

An objective of the invention is to provide a Christmas light apparatus and a lamp base of the Christmas light apparatus to overcome the disadvantage that the wires are easily disconnected from the pins of the conventional Christmas light apparatus.

The Christmas light apparatus of the invention has:

a holder having an inner surface and a space;

multiple electrode pads mounted on the inner surface of the holder;

a lamp base mounted in the space of the holder and having:

a top body having a top hole; and a bottom body extending from a bottom of the top body and having multiple bottom grooves communicating with the top hole of the top body; and an LED lamp mounted on the top body of the lamp base and having multiple pins each respectively having a free end, wherein the free ends of the pins pass through the lamp base and are respectively bent upward along the bottom grooves of the bottom body to be respectively pressed between the lamp base and the electrode pads.

The lamp base of the invention has:

a top body having a top hole; and a bottom body extending from a bottom of the top body and having multiple bottom grooves communicating with the top hole of the top body.

In conclusion, the pins of the LED lamp pass through the lamp base, extend from the bottom of the lamp base and are bent upward to be respectively pressed between the four surfaces of the lamp base and the electrode pads. The pins are then in close contact with the electrode pads. Hence, the LED lamp is securely mounted on the lamp base, and the pins of the LED lamp closely contact the electrode pads. The pins of the LED lamp can hardly be disconnected from the electrode pads, such that the Christmas light apparatus of the invention can be always normally activated.

In addition, an assembly worker mounts the LED lamp on the lamp base, bends the pins of the LED lamp upward and inserts the lamp base to the holder to complete assembly of the Christmas light apparatus of the invention, instead of welding wires to the pins of the LED lamp. Therefore, to assemble the Christmas light apparatus of the invention is easy and fast.

DETAILED DESCRIPTION OF THE PREFERRED EMBODIMENT

Figure 1:
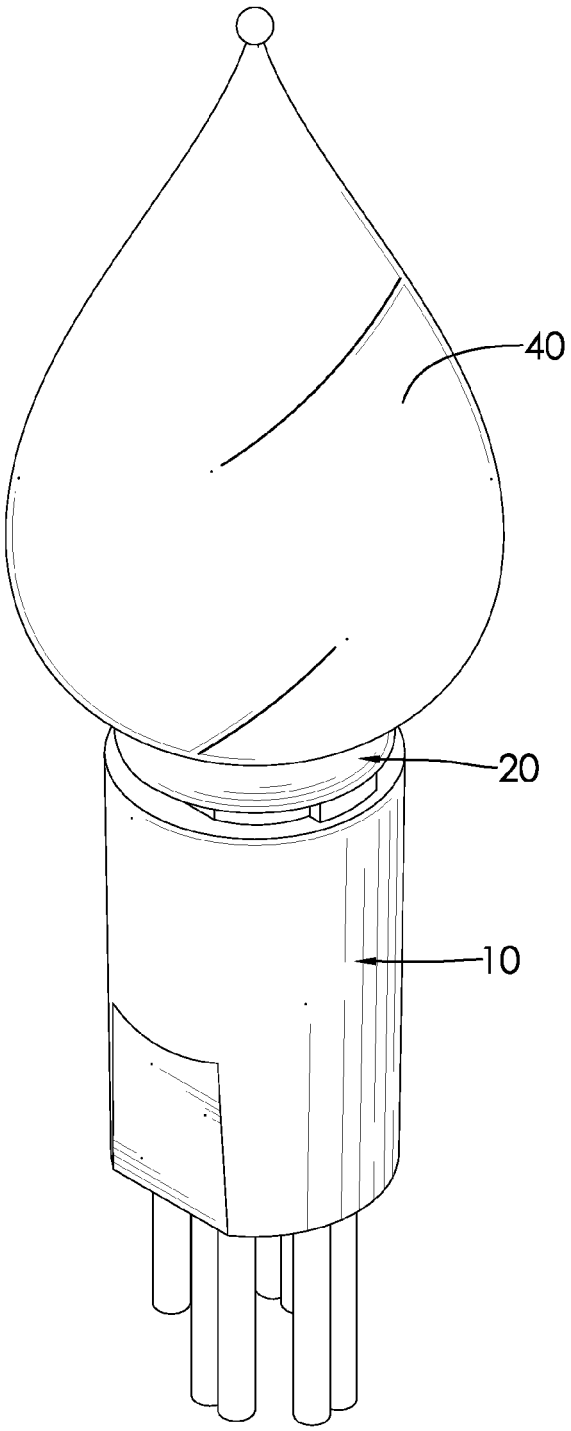
FIG. 1 is a perspective view of a first embodiment of the Christmas light apparatus of the invention.

With reference to FIGS. 1-4, a first embodiment of the Christmas light apparatus of the invention is disclosed. The Christmas light apparatus comprises a holder 10, multiple electrode pads 12, a lamp base 20 and an LED lamp 30. The Christmas light apparatus can further comprises a cover 40.

The holder 10 has an inner surface and a space 11. The space 11 has a top opening. The inner surface has multiple pad recesses 13.

The multiple electrode pads 12 are respectively mounted in the pad recesses 13. In this embodiment, the inner surface of the holder 10 has four pad recesses 13. Four electrode pads 12 are respectively mounted in the four pad recesses 13.

The lamp base 20 is mounted in the space 11 of the holder 10. The lamp base 20 has a top body 21 and a bottom body 22. The top body 21 has a top hole. The top hole of the top body 21 is partitioned into a first space 211 and a second space 212. In this embodiment, the top body 21 has a partition 213. The top hole of the top body 21 is partitioned by the partition 213 into the first space 211 and the second space 212.

The bottom body 22 extends from a bottom of the top body 21 and has a first surface 221, a second surface 222, a third surface 223, a fourth surface 224, at least one bottom hole and multiple bottom grooves. In this embodiment, the bottom body 22 has a first bottom hole 225, a second bottom hole 226, a first bottom groove 231, a second bottom groove 232, a third bottom groove 233 and a fourth bottom groove 234. The four surfaces 221-224 respectively face toward the electrode pads 12 mounted on the inner surface of the holder 10. The four bottom grooves 231-234 are formed in a bottom of the bottom body 22. The first bottom hole 225 communicates with the first space 211 of the top body 21, the first bottom groove 231 and the second bottom groove 232. The second bottom hole 226 communicates with the second space 212 of the top body 21, the third bottom groove 233 and the fourth bottom groove 234. The positions of the bottom grooves 231-234 respectively correspond to the positions of the surfaces 221-224 of the bottom body 22.

The LED lamp 30 is mounted on the top body 21 of the lamp base 20 and has multiple pins including a first pin 31, a second pin 32, a third pin 33 and a fourth pin 34. The four pins 31-34 each respectively have a free end passing through the lamp base 20. In this embodiment, the free ends of the first pin 31 and the second pin 32 pass through the first space 211 and the first bottom hole 225. The free ends of the third pin 33 and the fourth pin 34 pass through the second space 212 and the second bottom hole 226. The free ends of the four pins 31-34 are respectively bent upward along the four bottom grooves 231-234 and are respectively and tightly pressed between the surfaces 221-224 and the electrode pads 12, such that the free ends of the pins 31-34 are respectively and electrically connected to the electrode pads 12 and the pins 31-34 are electrically insulated from each other. When the LED lamp 30 is activated, the LED lamp 30 can display multiple colors.

The cover 40 is mounted on the top body 21 of the lamp base 20 to cover and protect the LED lamp 30.

Figure 5A:
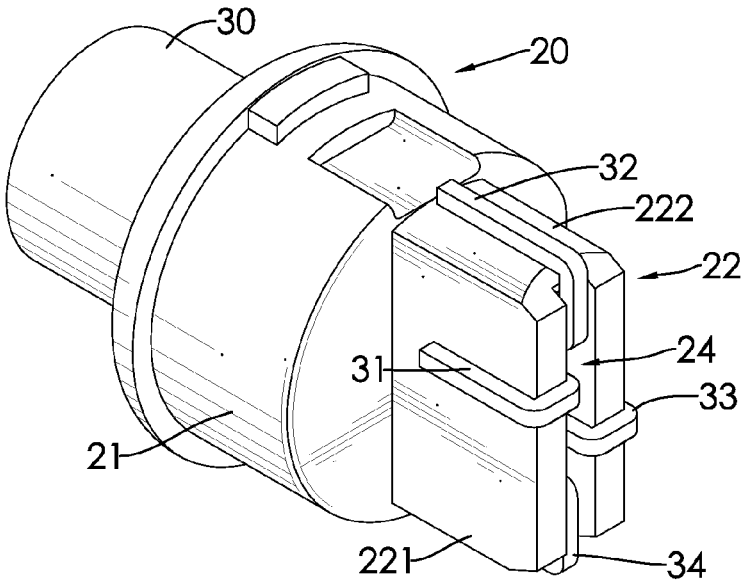
FIG. 5A is a perspective view of the lamp base with the LED lamp of a second embodiment of the Christmas light apparatus of the invention.
Figure 5B:
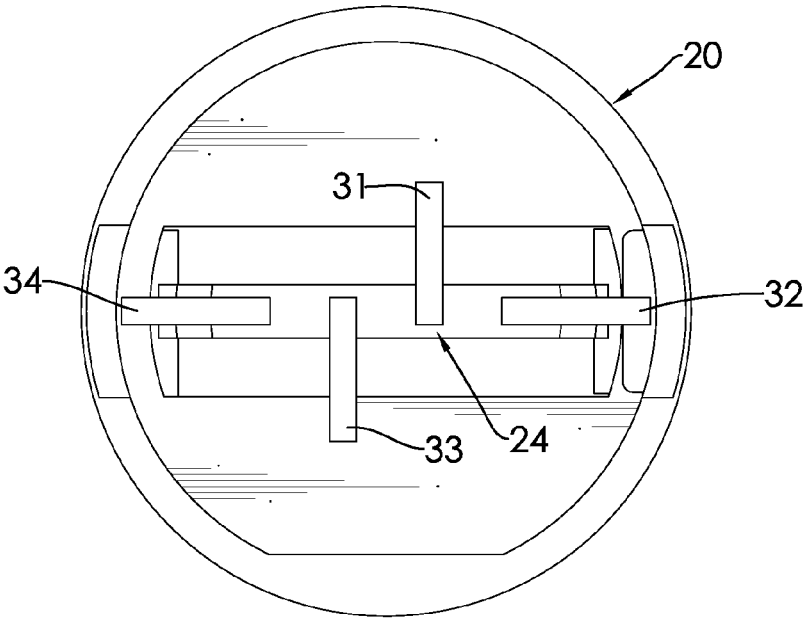
FIG. 5B is a bottom view of the lamp base with the LED lamp of the second embodiment of the Christmas light apparatus of the invention.

With reference to FIGS. 5A and 5B, a second embodiment of the invention is disclosed. The bottom body 22 of the lamp base 20 has only one bottom hole 24. The free ends of the four pins 31-34 of the LED lamp 30 pass through the bottom hole 24 and are bent upward to be respectively pressed between the surfaces of the bottom body and the electrode pads.

Figure 2:
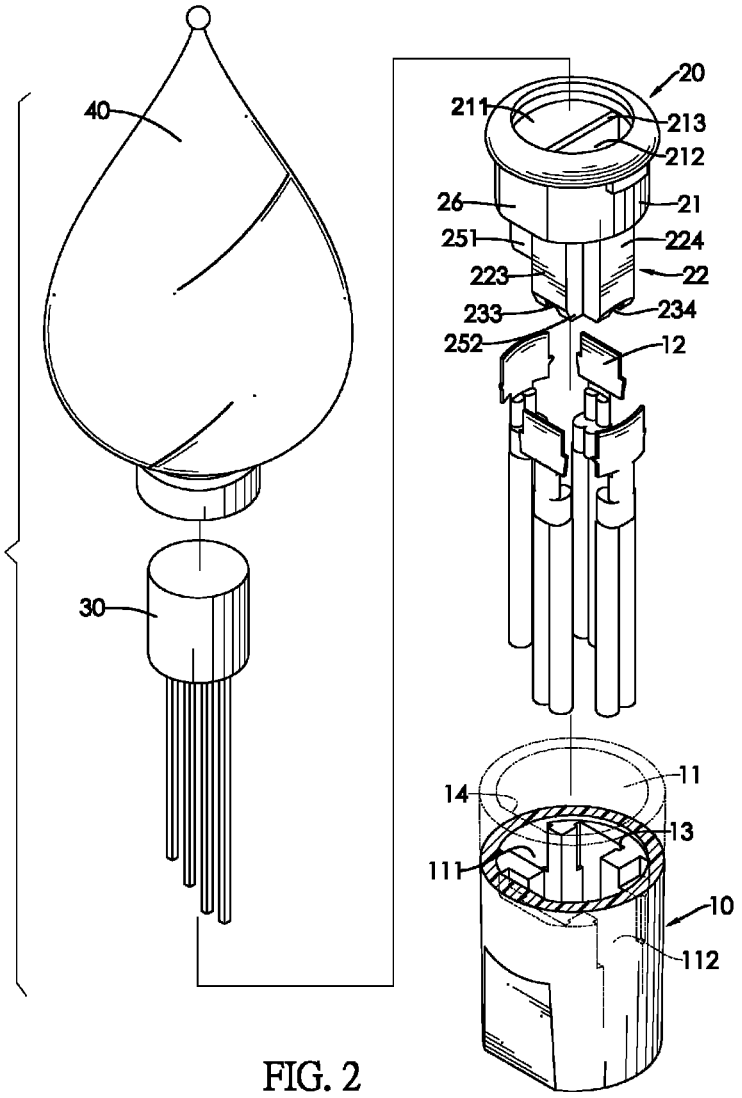
FIG. 2 is an exploded view of the first embodiment of the Christmas light apparatus of the invention.
Figure 3:
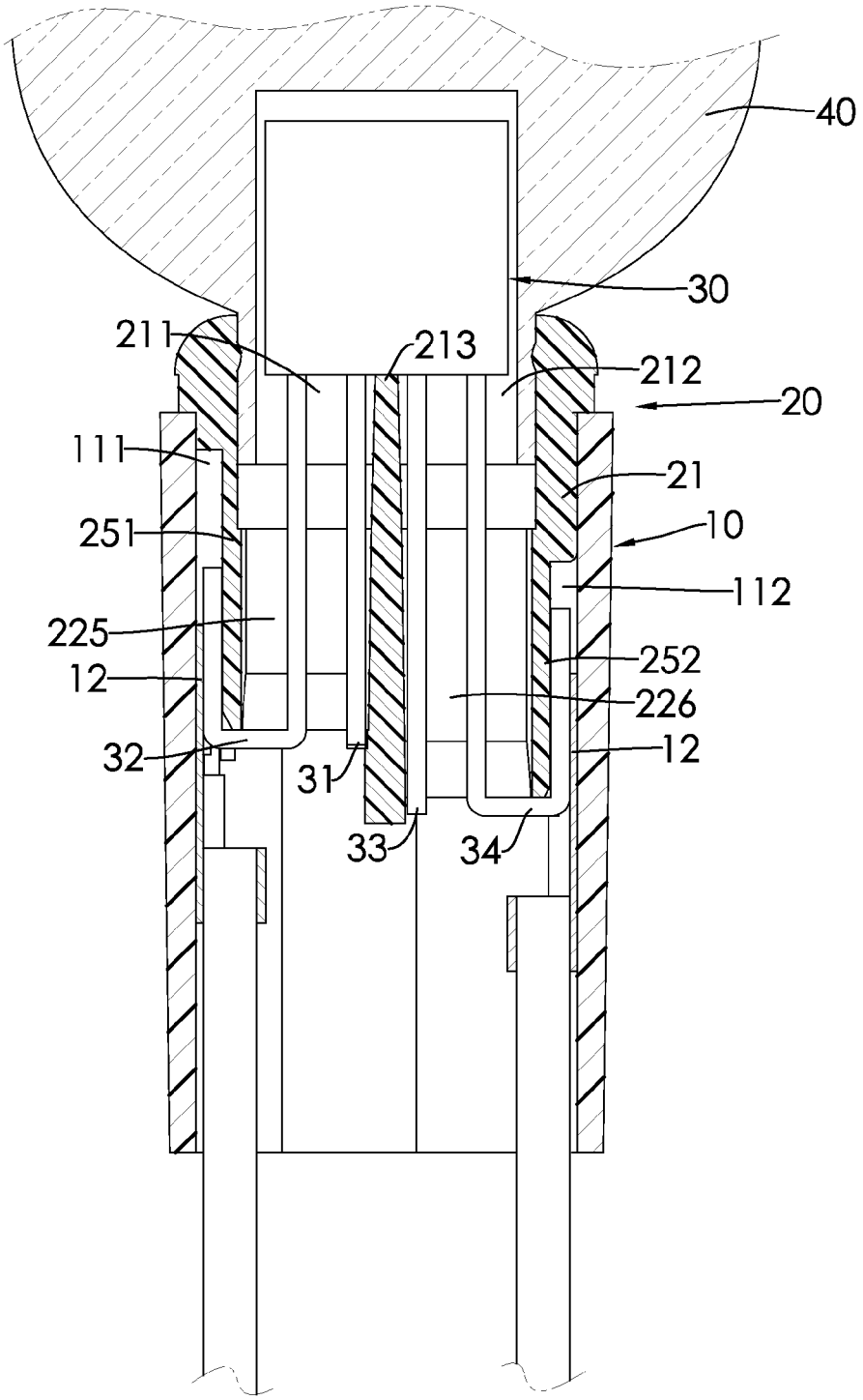
FIG. 3 is a partially cross-sectional view of the first embodiment of the Christmas light apparatus of the invention.
Figure 4:
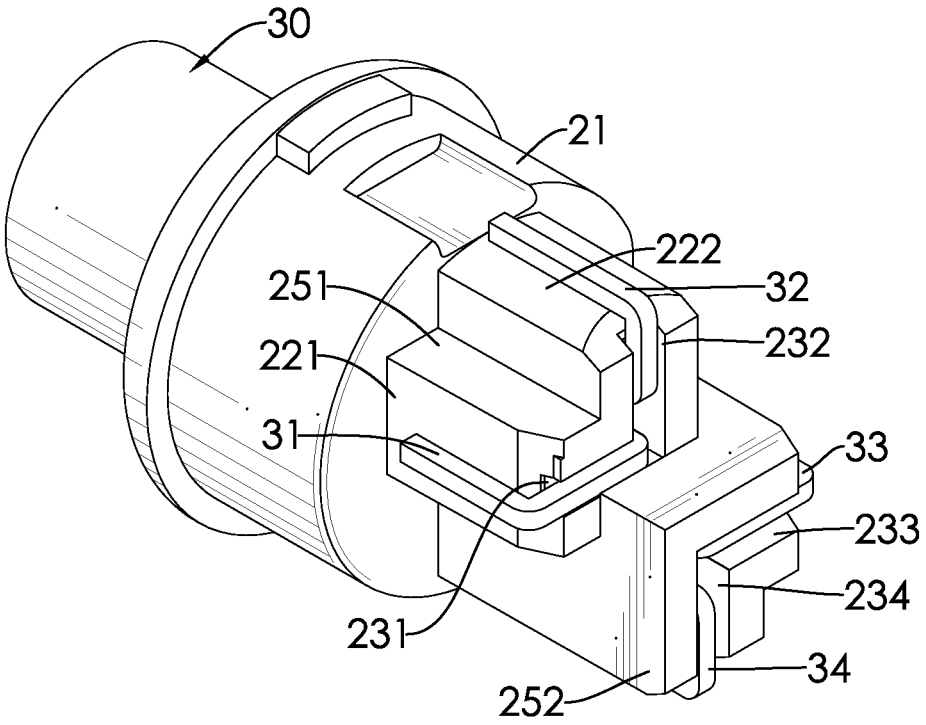
FIG. 4 is a perspective view of the lamp base of the Christmas light apparatus of the invention.
Figure 6:
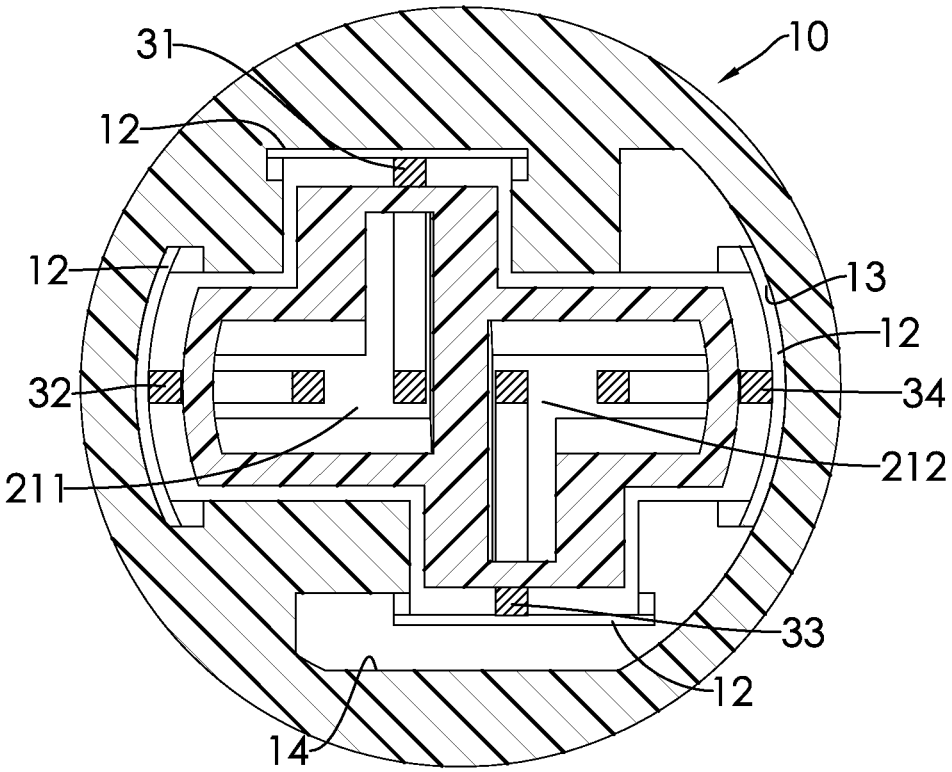
FIG. 6 is a cross-sectional view of the first embodiment of the Christmas light apparatus of the invention.

With reference to FIGS. 2, 4 and 6, the light apparatus of the invention has fool-proofing function. The bottom body 22 has a first pillar unit 251 and a second pillar unit 252. The first surface 221 and the second surface 222 are formed on the first pillar unit 251 and in the first bottom hole 225. The first bottom groove 231 and the second bottom groove 232 are formed in the first pillar unit 251. The third surface 223 and the fourth surface 224 are formed on the second pillar unit 252 and in the second bottom hole 226. The third bottom groove 233 and the fourth bottom groove 234 are formed in the second pillar unit 252. A length of the second pillar unit 252 is longer than a length of the first pillar unit 251. The third pin 33 and the fourth pin 34 are each correspondingly longer than the first pin 31 and than the second pin 32.

With reference to FIG. 2, the space 11 of the holder 10 includes a first hole 111 and a second hole 112. A depth of the second hole 112 is deeper than a depth of the first hole 111. The holder 10 may have a protrusion 14 formed in the space 11. The top body 21 of the lamp base 20 has a fool-proofing notch 26. The position of the protrusion 14 corresponds to the position of the fool-proofing notch 26. When the lamp base 20 is mounted in the holder 10, the first pillar unit 251 is inserted in the first hole 111 of the holder 10, the second pillar unit 252 is inserted in the second hole 112 of the holder 10, and the fool-proofing notch 26 of the lamp base 20 is aligned with the protrusion 14 of the holder 10.

Hence, before an assembly worker assembles the lamp base 20 to the holder 10, the assembly worker has to align the first pillar unit 251 with the first hole 111 of the holder 10, align the second pillar unit 252 with the second hole 112 of the holder 10, and align the protrusion 14 with the fool-proofing notch 26, such that the assembly worker can correctly insert the lamp base 20 in the holder 10. In addition, the pins 31-34 can contact the right pads 12, such that incorrect assembly of the LED lamp 30 is prevented. The assembly worker can also observe the length of the pins 31-34 on the surfaces 221-224 to determine whether the LED lamp 30 is correctly mounted on the lamp base 20.

When the first pillar unit 251 is incorrectly inserted in the second hole 112 and the second pillar unit 252 is incorrectly inserted in the first hole 111, the lamp base 20 cannot be completely mounted in the holder 10, such that the assembly worker can easily observe the lamp base 20 is not aligned with the holder 10.

Figure 7A:
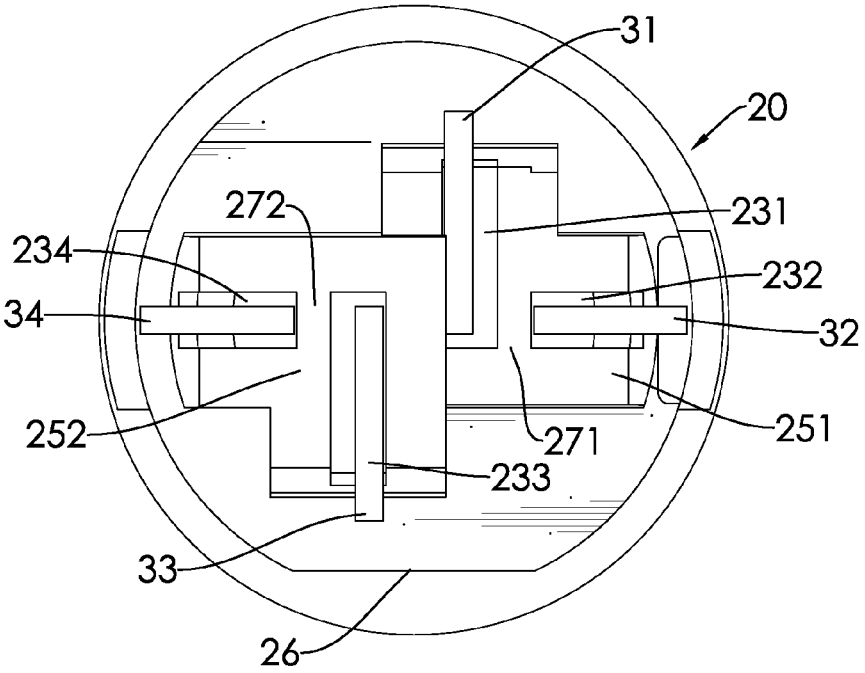
FIG. 7A is a bottom view of a third embodiment of the lamp base with the LED lamp of the Christmas light apparatus of the invention.
Figure 7B:
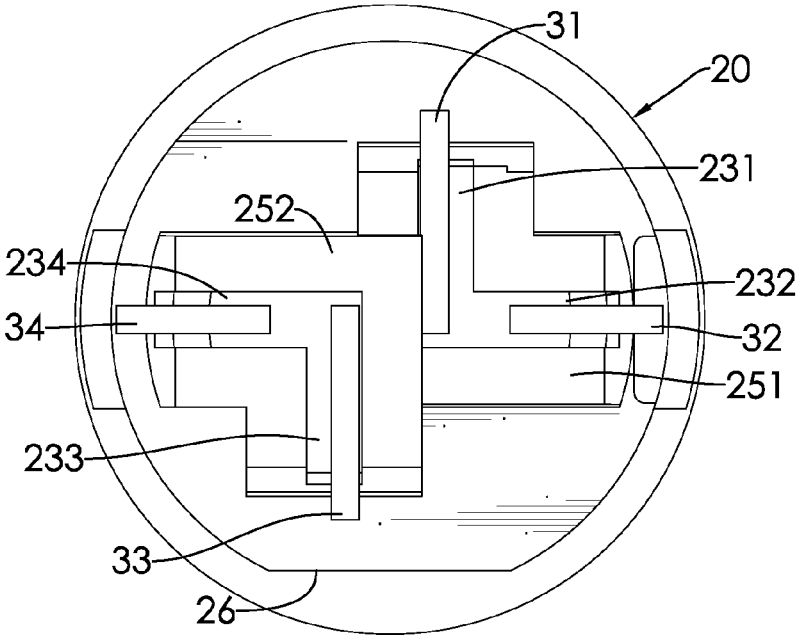
FIG. 7B is a bottom view of the first embodiment of the lamp base with the LED lamp of the Christmas light apparatus of the invention.
Figure 8:
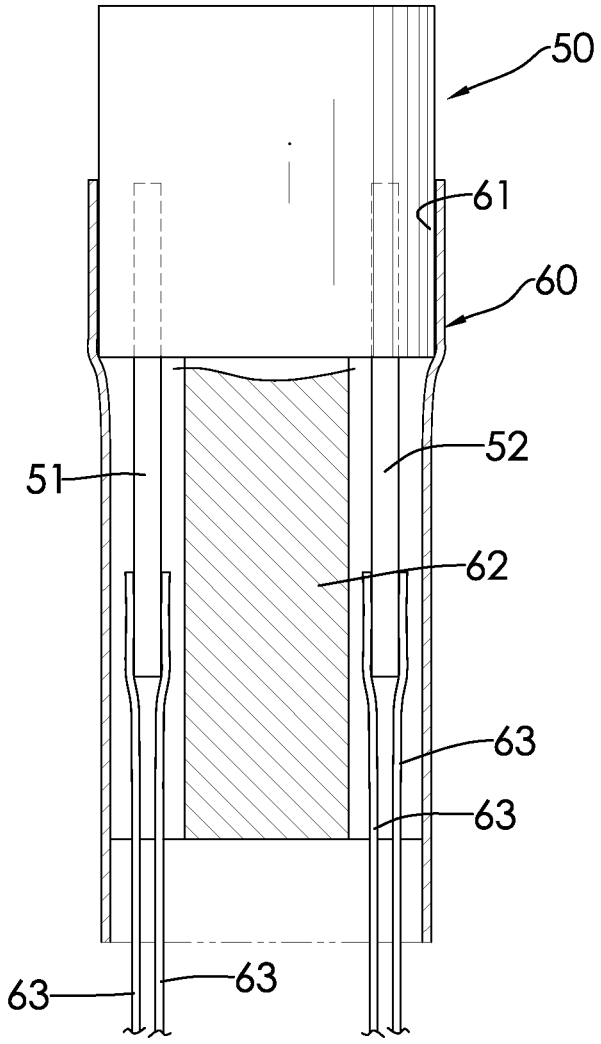
FIG. 8 PRIOR ART
FIG. 8 is a partially cross-sectional view of a conventional Christmas light apparatus.
Figure 9:
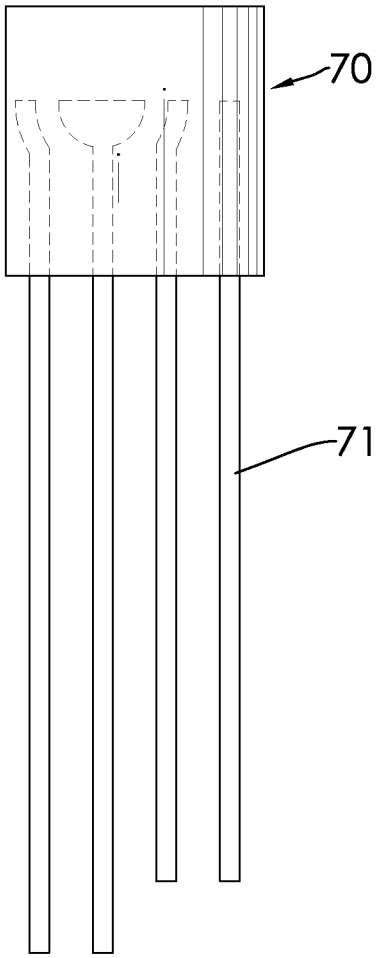
FIG. 9 PRIOR ART
FIG. 9 is a plan view of another conventional Christmas light apparatus.

With reference to FIG. 7A, a third embodiment of the invention is disclosed. With reference to FIG. 7B, a bottom view of the first embodiment is disclosed. Comparing FIG. 7A with FIG. 7B, the first pillar unit 251 of the third embodiment has a first partition 271 formed between the first bottom groove 231 and the second bottom groove 232. The second pillar unit 252 of the third embodiment has a second partition 272 formed between the third bottom groove 233 and the fourth bottom groove 234. Therefore, the four pins 31-34 of the LED lamp 30 are securely separated by the partitions 271, 272. The electrical insulation of the pins 31-34 of the LED lamp 30 is further confirmed.

In conclusion, the LED lamp 30 is detachably mounted on the lamp base 20 and the lamp base 20 is detachably mounted in the holder 10, such that the pins 31-34 of the LED lamp 30 can correctly contact the electrode pads 12. The assembly worker can easily assemble the light apparatus of the invention. The pins 31-34 of the LED lamp 30 are tightly pressed between the bottom body 22 and the electrode pads 12 and can hardly be disconnected from the electrode pads 12. The disadvantage that the pins of a conventional LED lamp are easily disconnected from wires melded to the pins is overcome.

What is claimed is:

1. A Christmas light apparatus comprising:

a holder having an inner surface and a space partitioned into a first hole and a second hole, wherein a depth of the second hole is deeper than a depth of the first hole;

multiple electrode pads mounted on the inner surface of the holder;

a lamp base mounted in the space of the holder and having:

a top body having a top hole; and a bottom body extending from a bottom of the top body and having multiple bottom grooves communicating with the top hole of the top body;

at least one bottom hole communicating with the top hole of the top body and the bottom grooves;

a first pillar unit inserted into the first hole of the holder; and a second pillar unit longer than the first pillar unit and inserted into the second hole of the holder; wherein the multiple bottom grooves and the at least one bottom hole are formed in the first pillar unit and the second pillar unit; and an LED lamp mounted on the top body of the lamp base and having multiple pins each respectively having a free end, wherein the free ends of the pins pass through the lamp base and are respectively bent upward along the bottom grooves of the bottom body to be respectively pressed between the lamp base and the electrode pads.

2. The Christmas light apparatus as claimed in claim 1, wherein the top hole of the top body is partitioned to multiple spaces respectively communicating with the at least one bottom hole of the bottom body.

3. The Christmas light apparatus as claimed in claim 2, wherein the top body of the lamp base has a partition;

the top hole of the top body is partitioned by the partition into a first space and a second space;

the bottom grooves of the bottom body include a first bottom groove, a second bottom groove, a third bottom groove and a fourth bottom groove formed in a bottom of the bottom body;

the at least one bottom hole of the bottom body of the lamp base includes a first bottom hole and a second bottom hole;

the first bottom hole communicates with the first space of the top body, the first bottom groove, and the second bottom groove;

the second bottom hole communicates with the second space, the third bottom groove and the fourth bottom groove;

the multiple pins of the LED lamp includes:

a first pin and a second pin passing through the first space of the top body and the first bottom hole of the bottom body and being respectively bent upward along the first bottom groove and the second bottom groove; and a third pin and a fourth pin passing through the second space of the top body and the second bottom hole of the bottom body and being respectively bent upward along the third bottom groove and the fourth bottom groove.

4. The Christmas light apparatus as claimed in claim 3, wherein the first bottom hole, the first bottom groove and the second bottom groove are formed in the first pillar unit; and the second bottom hole, the third bottom groove and the fourth bottom groove are formed in the second pillar unit.

5. The Christmas light apparatus as claimed in claim 4, wherein the holder has a protrusion formed in the space; and the top body of the lamp base has a fool-proofing notch aligned with the protrusion.

6. The Christmas light apparatus as claimed in claim 5, wherein a length of the first pin and a length of the second pin each respectively correspond to a length the first pillar unit; and a length of the third pin and a length of the fourth pin each respectively correspond to a length the second pillar unit.

7. The Christmas light apparatus as claimed in claim 6, wherein the inner surface of the holder has multiple pad recesses; and the multiple electrode pads are respectively mounted in the pad recesses.

8. The Christmas light apparatus as claimed in claim 7 further comprising a cover mounted on the top body of the lamp base to cover the LED lamp.

9. A lamp base having:

a top body having a top hole; and a bottom body extending from a bottom of the top body and having a first pillar unit;

a second pillar unit;

a first bottom hole, a first bottom groove, and a second bottom groove formed in the first pillar unit and communicating with the top hole of the top body;

a second bottom hole, a third bottom groove, and a fourth bottom groove formed in the second pillar unit and communicating with the top hole of the top body;

the top hole of the top body is partitioned to multiple spaces respectively communicating with the first bottom hole and the second bottom hole of the bottom body;

the top body of the lamp base has a partition;

the top hole of the top body is partitioned by the partition into a first space and a second space;

the first bottom groove, the second bottom groove, the third bottom groove and the fourth bottom groove are formed in a bottom of the bottom body;

the bottom body of the lamp base has the first bottom hole and the second bottom hole;

the first bottom hole communicates with the first space of the top body, the first bottom groove and the second bottom groove; and the second bottom hole communicates with the second space, the third bottom groove, and the fourth bottom groove.

10. The lamp base as claimed in claim 9, wherein the top body has a fool-proofing notch.

* * * * *